US007093830B2

(12) United States Patent
Kang

(10) Patent No.: US 7,093,830 B2
(45) Date of Patent: Aug. 22, 2006

(54) PAPER FEEDING DEVICE FOR INKJET PRINTER

(75) Inventor: Sung-wook Kang, Seoul (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 180 days.

(21) Appl. No.: 10/688,968

(22) Filed: Oct. 21, 2003

(65) Prior Publication Data

US 2004/0141785 A1 Jul. 22, 2004

(30) Foreign Application Priority Data

Jan. 17, 2003 (KR) ..... 10-2003-0003431

(51) Int. Cl.
*B65H 3/06* (2006.01)
*B65H 3/52* (2006.01)

(52) U.S. Cl. ..... 271/118; 271/117

(58) Field of Classification Search ..... 400/578; 271/363, 121, 124, 117, 167, 146, 137, 118, 271/3.14; 242/264; 173/146; 74/159
See application file for complete search history.

(56) References Cited

U.S. PATENT DOCUMENTS 4,550,902 A * 11/1985 Godlewski ..... 271/10.02
5,547,181 A * 8/1996 Underwood ..... 271/114
5,868,385 A * 2/1999 Embry et al. ..... 271/118
5,899,450 A * 5/1999 Gettelfinger et al. ..... 271/121
6,065,886 A * 5/2000 Embry et al. ..... 400/629
6,279,897 B1 * 8/2001 Richards ..... 271/121
6,290,221 B1 * 9/2001 Taniyama ..... 271/3.14
6,352,256 B1 * 3/2002 Hsieh ..... 271/110
6,382,619 B1 * 5/2002 Gustafson et al. ..... 271/117
6,764,072 B1 * 7/2004 Gaarder ..... 271/121

* cited by examiner

*Primary Examiner*—Kathy Matecki
*Assistant Examiner*—Rakesh Kumar
(74) *Attorney, Agent, or Firm*—Staas & Halsey LLP

(57) ABSTRACT

A paper feeding device of an inkjet printer includes a motor generating a drive force, a pickup drive shaft rotated by the motor, a pivoting link housing disposed on the pickup drive shaft, a pickup roller connected to the ling housing, and a clutch enlinking the pickup drive shaft and the link housing enabling the link housing to pivot by a predetermined angle by rotation of the pickup drive shaft.

15 Claims, 5 Drawing Sheets

PAPER FEEDING DEVICE FOR INKJET PRINTER

CROSS-REFERENCE TO RELATED APPLICATIONS

This application claims the benefit of Korea Application No. 2003-3431, filed Jan. 17, 2003, in the Korean Intellectual Property Office, the disclosure of which is incorporated herein by reference.

BACKGROUND OF THE INVENTION

1. Field of the Invention

The present invention relates to an inkjet printer, and more particularly, to a paper feeding device for an inkjet printer.

2. Description of the Related Art

An inkjet printer is a printing apparatus that creates an image on a sheet of paper by spraying ink through a print head, and typically has a front insert front out (FIFO) feeding structure in which paper is supplied and discharged in the same direction.

FIG. 1 shows an example of an inkjet printer having the FIFO feeding structure. Referring to FIG. 1, the inkjet printer comprises a print head 10 that sprays ink onto a sheet of paper, a feed cassette 20 in which paper is stacked, and a paper feeding device 30 that supplies the stacked paper to the print head 10. The paper feeding device 30 comprises a pickup roller 31 that picks up the stacked paper, a drive roller 32 that conveys the picked up paper, and a feeding roller that conveys the conveyed paper towards the print head 10 in increments.

When the pickup roller 31 is driven, the paper stacked in the feed cassette 20 is separated sheet by sheet by a separation wall 21 and picked up. The picked up paper proceeds between the drive roller 32 and a pinch roller 34 pressing the drive roller 32 with a predetermined force, and is moved towards the feeding roller 33 by the drive roller 32. The paper conveyed to the feeding roller 33 is transferred to below the print head 10 by the feeding roller 33 and the friction roller 35 disposed above the feeding roller 33. When the paper arrives on the paper guide 40 disposed below the print head 10, the print head 10 prints an image by spraying ink onto the paper while moving left and right along the guide bar 11. The discharge roller 50 discharges the paper with the image printed thereon outside the device.

Since it takes time for the print head 10 to spray ink on the paper while moving along a line, the feeding roller 33 line-feeds paper to the paper guide 40 at a predetermined interval. In order to line-feed, a line-feed (LF) motor (not shown) is used for driving the feeding roller 33. The LF motor not only drives the feeding roller 33 but also the pickup roller 31 selectively. That is, when the LF motor rotates forward, the feeding roller 33 is driven in the paper convey direction A. When the LF motor rotates backward, the feeding roller 33 rotates in the reverse direction B. Concurrently, a driving force is transmitted to the pickup roller 31 whereby the pickup roller 31 rotates in the paper pickup direction C and picks up the paper. Here, a swing gear or a one-way clutch selectively transmits a driving force to the pickup roller 31. When the paper picked up by the pickup roller 31 reaches the feeding roller 33 rotating in the reverse direction B by the drive roller 32, the LF motor rotates forward again thereby rotating the feeding roller 33 in the paper convey direction A. At this time, the pickup roller 31 rests on the paper as it does not receive any driving force, and the paper is line fed to the paper guide 40 by the feeding roller 33.

However, such a conventional paper feeding device 30 of an inkjet printer prevents the drive roller 32 and the feeding roller 33 from smoothly conveying the paper since the pickup roller 31 rests on the paper even after a sheet of paper is picked up. Accordingly, paper is not smoothly conveyed to the printer head. Thus, print quality deteriorates. Moreover, if the pickup roller 31 does not press the paper with the same load each time paper is picked up, the paper can be skewed or jammed.

SUMMARY OF THE INVENTION

Additional aspects and advantages of the invention will be set forth in part in the description which follows and, in part, will be obvious from the description, or may be learned by practice of the invention.

An aspect of the invention is to solve at least the above problems and/or disadvantages and to provide at least the advantages described hereinafter.

One aspect of the present invention is to solve the foregoing and/or other problems by providing a paper feeding device of an inkjet printer which conveys paper to a print head smoothly and precisely by lifting a pickup roller towards a feed cassette after the paper is picked up, and therefore preventing a pickup roller from pressing the paper.

The foregoing and/or other aspects and advantages are realized by providing a paper feeding device of an inkjet printer comprising a motor generating a drive force; a pickup drive shaft rotated by the motor; a pivoting link housing disposed on the pickup drive shaft; a pickup roller connected to the link housing; and a clutch enlinking the pickup drive shaft and the link housing enabling the link housing to pivot by a predetermined angle by rotation of the pickup drive shaft.

The clutch comprises a fixing member fixed on the pickup drive shaft to be in contact with a first outer surface of the link housing, and a press disposed on the pickup drive shaft for pressing the link housing towards the fixing member.

The press comprises a pressing plate fixed around the pickup drive shaft, and a pressing spring disposed between the pressing plate and a second outer surface of the link housing.

In addition, the press comprises a pressing plate fixed around the pickup drive shaft, and a rubber plate between the pressing plate and the second outer surface of the link housing.

Also, the press may comprise a pressing plate fixed around the pickup drive shaft, and a cork plate disposed between the pressing plate and the second outer surface of the link housing.

In an embodiment of the invention, an abrasion prevention member is disposed on the second outer surface of the link housing to be in contact with the pressing member.

The clutch may be a one way clutch comprising an inner race disposed on the outer surface of the pickup drive shaft, and an outer race disposed in the link housing to be in contact with an outer surface of the inner race with a predetermined frictional force.

The link housing comprises a first link housing disposed on the pickup drive shaft covering the pickup drive gear disposed on the pickup drive shaft, and a second link housing disposed in the first link housing. The second link housing pivots by a predetermined angle and includes a pickup roller gear geared with the pickup drive gear. The pickup drive gear causes the pickup roller gear to rotate.

BRIEF DESCRIPTION OF THE DRAWINGS

These and/or other aspects and advantages of the invention will be more readily appreciated from the following description of the preferred embodiments with reference to the accompanying drawings in which.

DETAILED DESCRIPTION OF THE PREFERRED EMBODIMENTS

Figure 1:
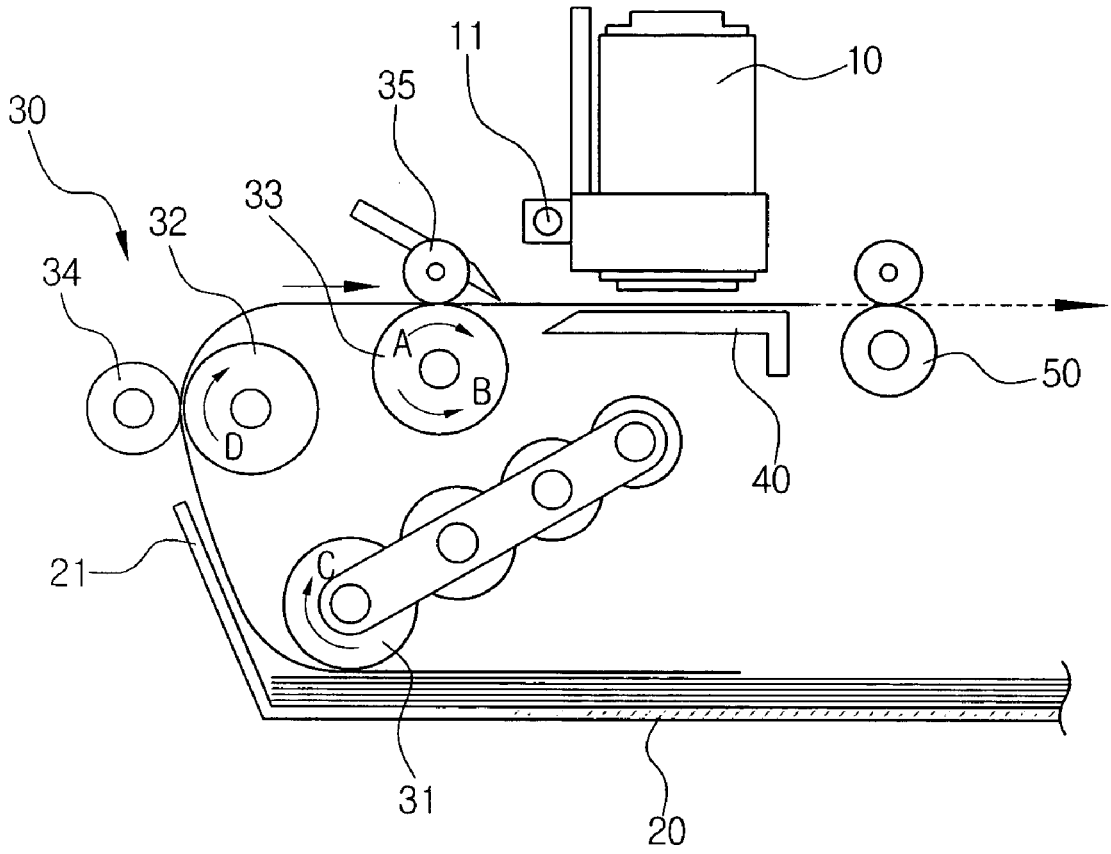
FIG. 1 (PRIOR ART)
FIG. 1 schematically shows the structure of a conventional inkjet printer.

Hereinafter, a paper feeding device of an inkjet printer according to embodiments of the present invention will be described in greater detail with reference to the accompanying drawings. With respect to the elements identical to those of the prior art, like reference numerals will be assigned.

Figure 2:
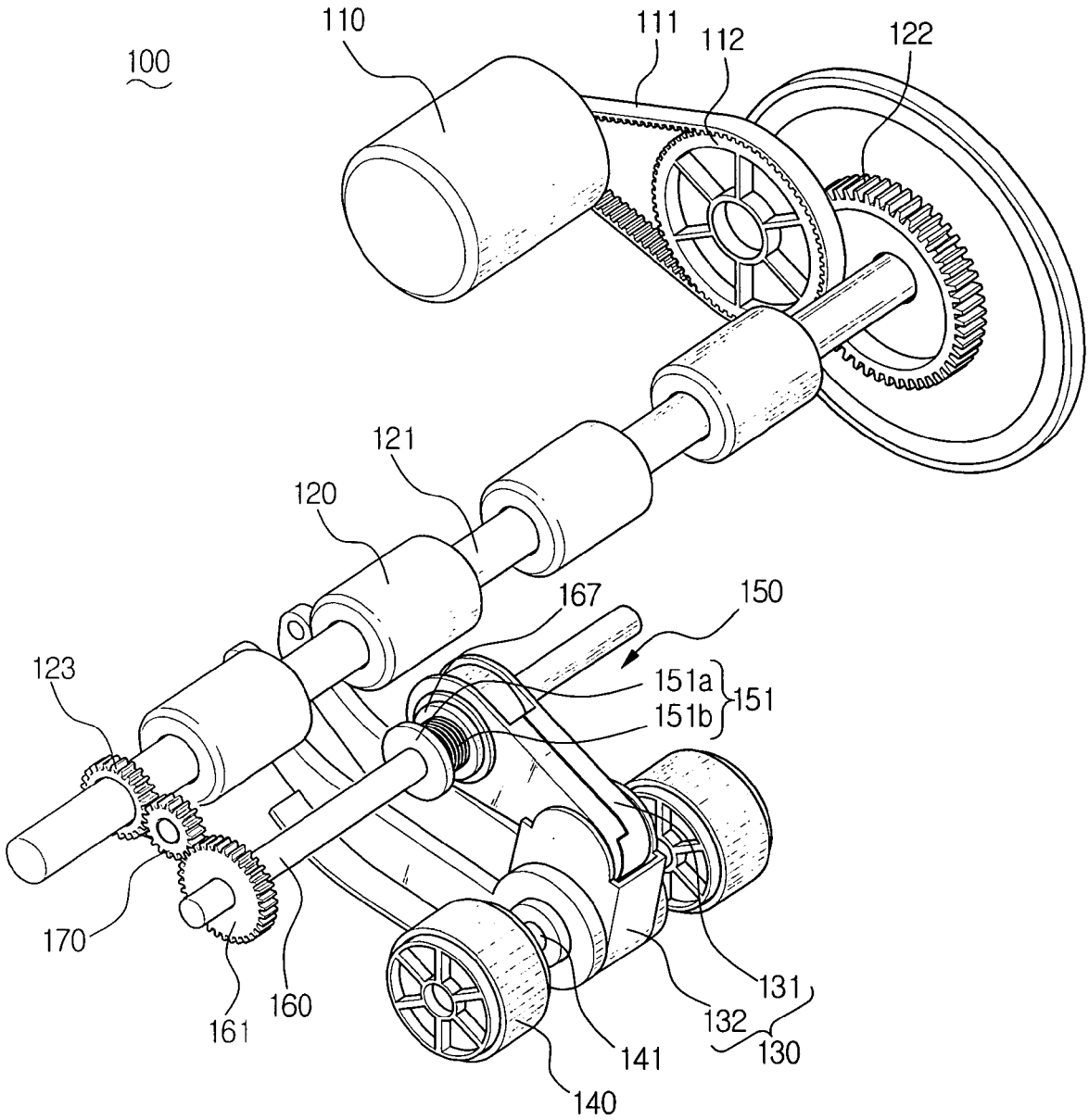
FIG. 2 is a perspective view showing a paper feeding device of an inkjet printer according to an embodiment of the present invention.

As shown in FIG. 2, a paper feeding device 100 of an inkjet printer according to an embodiment of the present invention comprises a motor 110, a feeding roller 120, a link housing 130, a pickup roller 140 and a clutch 150.

The motor 110 is a power source that drives the feeding roller 120 and the pickup roller 140, and generally is a DC motor. The motor 110 mainly drives the feeding roller 120 to line-feed and therefore is also called an LF motor. The motor 110 is connected with a timing belt 111 and the timing belt 111 is connected with a reduction gear 112.

The feeding roller 120 line-feeds a paper picked up by the pickup roller 140 towards the print head 10 (FIG. 1) and the feeding roller 120 is disposed around the feed-driving shaft 121 with a feeding gear 122 disposed thereon. The feed-driving shaft 121 is supported to a frame (not shown) of the inkjet printer and the feeding gear 122 is geared with the reduction gear 112.

Figure 5:
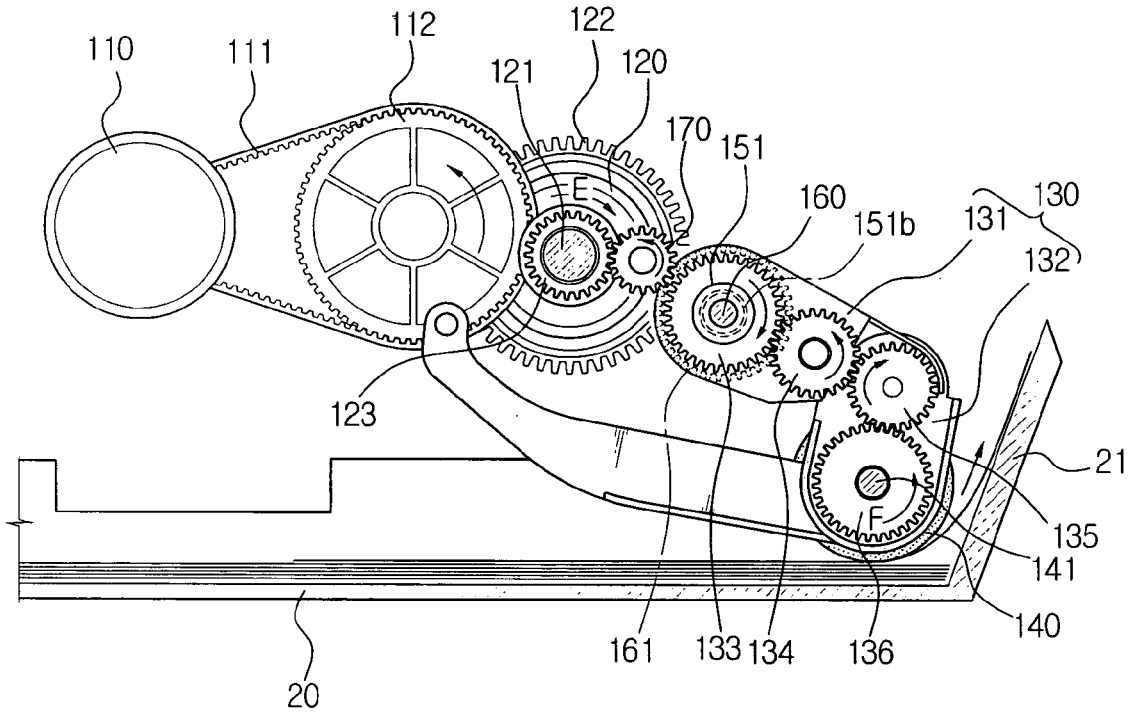
FIGS. 5 and 6 shows a side sectional view for illustrating the operation of the paper feeding device of an inkjet printer according to an embodiment of the present invention.

The link housing 130 supports the pickup roller 140 and is connected with a pickup drive shaft 160. The pickup drive shaft 160 transmits a drive force of the motor 110 to the pickup roller 140. The frame of the inkjet printer supports the pickup drive shaft 160 that has a second gear 161 disposed at one end. The second gear 161 is coupled to a first gear 123 disposed on the feed-driving shaft 121 through an idle gear 170. Accordingly, when the motor 110 drives, the pickup drive shaft 160 rotates in connection with the feed-driving shaft 121. In addition, as shown in FIG. 5, the pickup drive shaft 160 is equipped with a pickup driving gear 133 that drives the pickup roller 140.

The link housing 130 comprises a first link housing 131 and a second link housing 132. The first link housing 131 is connected with the pickup drive shaft 160 while covering the pickup drive gear 133. As shown in FIG. 5, the first link housing 131 includes the pickup drive gear 133 and a first idle gear 134 engaged with the pickup drive gear 133. Additionally, the first outer surface of the first link housing 131 is in contact with a fixing member 152 (FIG. 3) and an abrasion prevention member 167 is disposed on the second outer surface.

The second link housing 132 is pivotably disposed at an end of the first link housing 131. As shown in FIG. 5, the second link housing 132 has a second idle gear 135 engaged with the first idle gear 134 and a pickup roller gear 136 engaged with the second idle gear 135 disposed therein. The pickup roller gear 136 is connected with a pickup roller shaft 141. Accordingly, a driving force of the motor 110 transmitted to the pickup drive gear 133 is transmitted to the pickup roller gear 135 and the pickup roller shaft 141 through the first and second idle gears 134, 135.

The pickup roller 140 picks up the paper stacked in the feed cassette 20 sheet by sheet and forwards the picked up paper towards the feeding roller 120 and disposed at both ends of the pickup roller shaft 141 in pairs.

Figure 3:
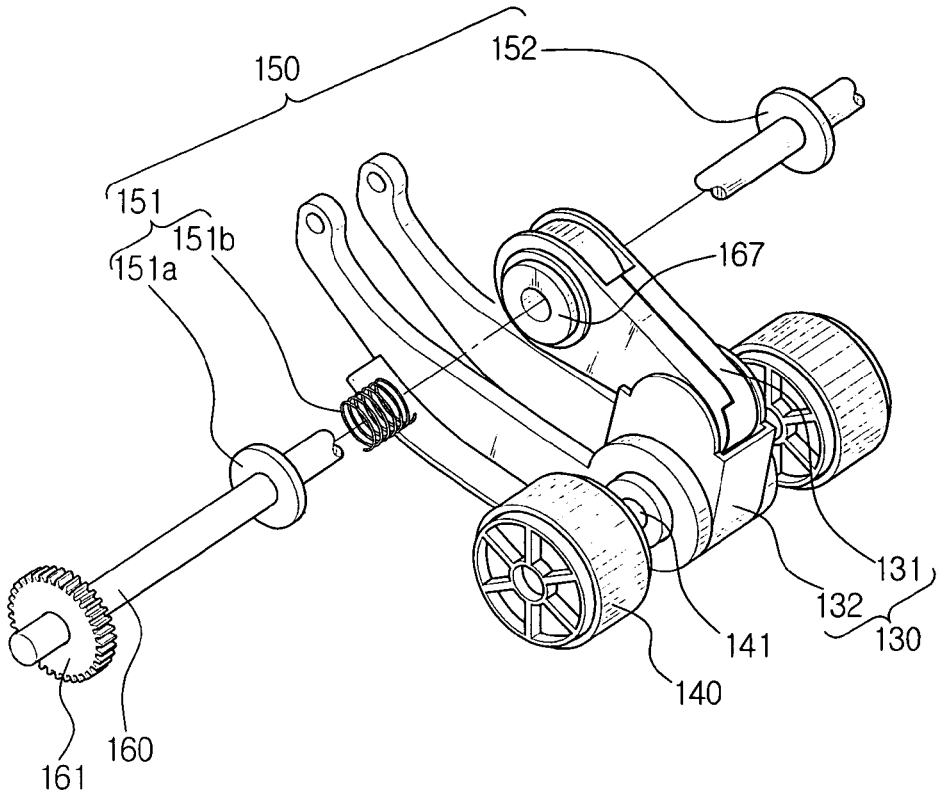
FIG. 3 is an exploded perspective view showing essential parts of the inkjet printer of FIG. 2.

As shown in FIG. 3, the clutch 150 links the link housing 130 and the pickup drive shaft 160. This allows the link housing 130 to pivot by a predetermined angle by the rotation of the pickup drive shaft 160, and comprises a press 151 and the fixing member 152. The press 151 and the fixing member 152 are disposed on the pickup drive shaft 160 to correspond with each other. The first link housing 131 is disposed in between the press 151 and the fixing member 152. The press 151 comprises a pressing plate 151*a* and a pressing spring 151*b*. The pressing plate 151*a* is disposed around the pickup drive shaft 160 and separate from the second outer surface of the first link housing 131. The pressing spring 151*b* is interposed between the pressing plate 151*a* and the abrasion prevention member 167 of the first link housing 131. The pressing spring 151*b* presses the first link housing 131 against the fixing member 152. The first outer surface of the first link housing 131 contacts the fixing member 152. Due to the operation of the pressing spring 151*b*, friction occurs between the first outer surface of the first link housing 131 and the fixing member 152, and between the abrasion prevention member 167 of the first link housing 131 and the pressing spring 151*b*. The pickup drive shaft 160 and the link housing 130 are linked by this friction. Here, the first outer surface of the first link housing 131 and the fixing member 152, and the second outer surface of the first link housing 131 and the pressing spring 151*b* are respectively in close contact with each other. When an external force greater than the frictional force is applied to the contact surfaces of the link housing 130 and the pickup drive shaft 160, a slip occurs between the contact surfaces.

The pressing spring 151*b* may be interposed between the pressing plate 151*a* and the abrasion prevention member 167 of the first link housing 131. Alternatively, the pressing spring may have one end fixed to the pressing plate 151*a*. The pressing spring 151*b* may be replaced by various other friction members such as a rubber plate or a cork plate which can be resiliently modified and therefore press the link housing 130 against the fixing member 152.

Figure 4:
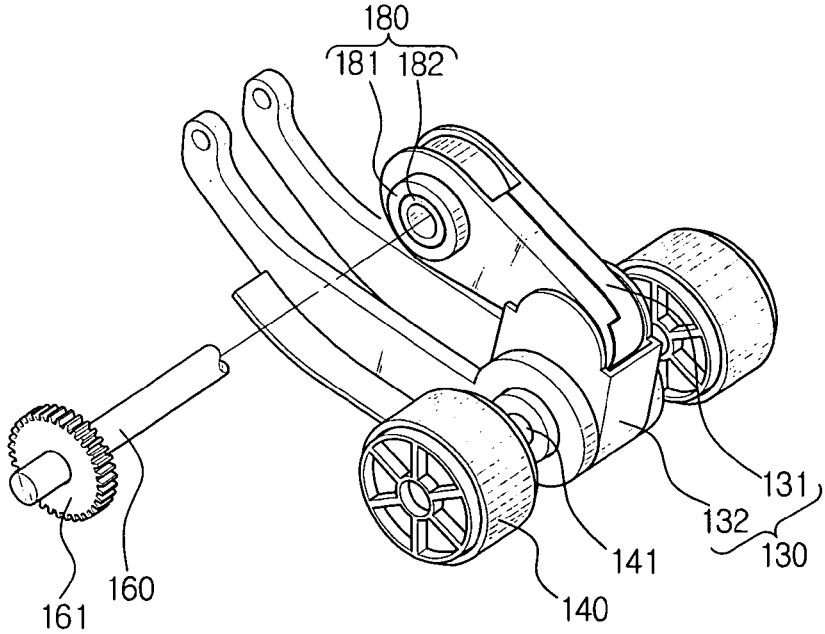
FIG. 4 is an exploded perspective view showing essential parts of a paper feeding device of an inkjet printer according to another embodiment of the present invention.

In addition, as shown in FIG. 4, a one-way clutch 180 may link the pickup drive shaft 160 and the link housing 130. The one-way clutch 180 comprises an outer race 181 and an inner race 182. The one-way clutch 180 is disposed at one side of the first link housing 131. In this case, the outer race 181 is fixed in the first link housing 131 and the inner race 182 has the pickup drive shaft 160 inserted therein.

Figure 6:
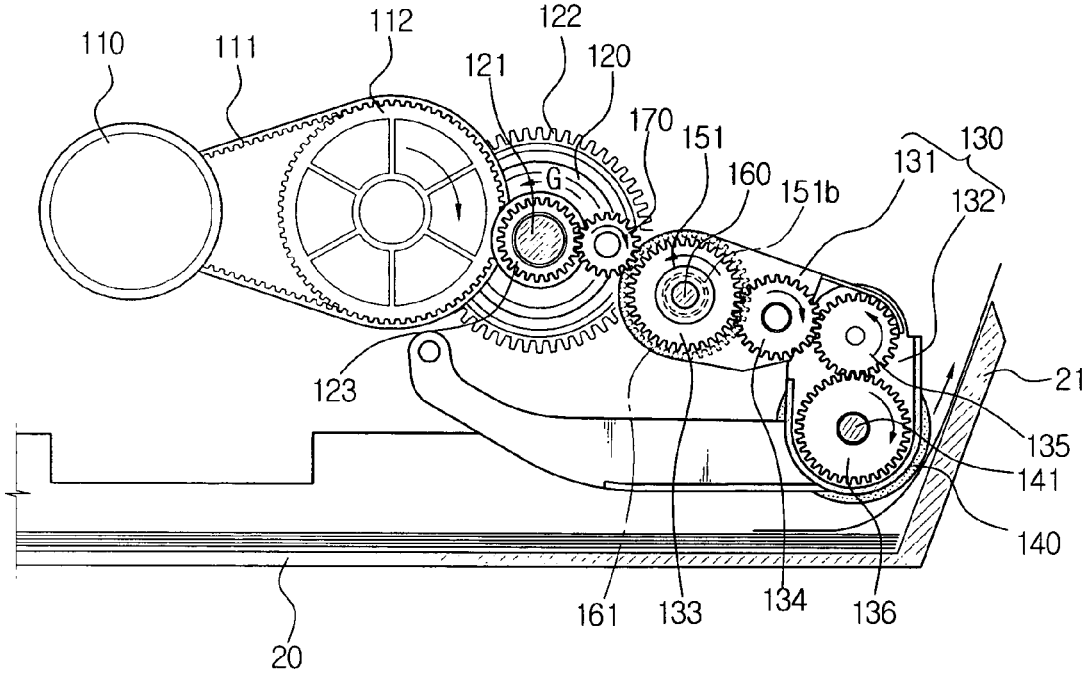

Hereinafter, the operation of the paper feeding device of an inkjet printer according to the present invention will be described referring to FIGS. 5 and 6.

When the printing starts, the motor 110 rotates backwards thereby rotating the pickup roller 140 in the paper pickup direction F. The reduction gear 112 connected to the timing belt 111 rotates counter clockwise, and the feeding gear 122 connected to the reduction gear 112 rotates clockwise. Accordingly, the feed-driving shaft 121 connected with the feeding gear 122 and the feeding roller 120 rotates in the reverse paper convey direction E, and the second gear 161 geared with the first gear 123 disposed at the end of the feed-driving shaft 121 through the idle gear 170 rotates the pickup drive shaft 160 clockwise. The first outer surface of the first link housing 131 is in close contact with the fixing member 152, as shown in FIG. 3. The second outer surface of the first link housing 181 is in contact with the pressing spring 151*b* of the pickup drive shaft 160 with a predetermined frictional force. The first link housing 137 pivots clockwise by a predetermined angle around the pickup drive shaft 160. When the pickup roller 140, disposed at the lower end of the second link housing 132, comes in contact with the paper stacked in the feed cassette 20, the first link housing 131 is prevented from pivoting. A slip occurs between the first outer surface of the first link housing 131 and the fixing member 152, and between the second outer surface of the first link housing 131 and the pressing spring 151*b*. Accordingly, the pickup roller 140 stays in press contact with the paper.

Since the pickup drive gear 133 fixed around the pickup drive shaft 160 rotates clockwise, the pickup roller gear 136 geared with the pickup drive gear 133 through the first and second idle gears 134, 135 rotates counter clockwise. Accordingly, the pickup roller 140 disposed on both ends of the pickup roller shaft 141 connected with the pickup roller gear 136 picks up a sheet of paper stacked in the feed cassette 20 at a time while rotating in the paper pickup direction F. When paper is separated by a separation wall 21 sheet by sheet and the separated paper reaches the feeding roller 120, the paper comes in contact with the outer surface of the feeding roller 120 rotating in the reverse paper convey direction E and the front end of the paper is adjusted to be in parallel with the feeding roller 120.

The rotation direction of the motor 110, the feeding roller 120, and the pickup roller 140 then change. The feeding gear 122, the feed-driving shaft 121, and the feeding roller 120 begin rotating in the paper convey direction G, and the paper is line fed towards the print head 10 (FIG. 1) by the feeding roller 120. In addition, the second gear 161 connected with the first gear 123 disposed at the end of the feed-driving shaft 121 through the idle gear 170 rotates counter clockwise and therefore the pickup drive shaft 160 also rotates counter clockwise. When the rotation direction of the pickup drive shaft 160 changes, friction in the reverse direction occurs between the first outer surface of the first link housing 131 and the fixing member 152 and between the second outer surface of the first link housing 131 and the pressing spring 151*b*. The pickup drive shaft 160 and the first link housing 131 thus become enlinked again. Therefore, the first link housing 131, which was pivoting counter clockwise in the same rotation direction of the pickup drive shaft 160, stops pivoting when the upper surface of the first link housing 131 comes in contact with a frame (not shown) of the inkjet printer or a stopper member (not shown) disposed on the frame.

The pickup roller 140 disposed at the end of the first link housing 131 is separated by a predetermined distance from the paper stacked in the feed cassette 20. A slip occurs between one side of the outer surface of the first link housing 131 and the fixing member 152, and between the other side of the outer surface of the first link housing 131 and the pressing spring 151*b*. Since there is a friction while the slip is occurring, the pickup roller 140 remains separated from the paper.

After printing is completed and when a new printing operation begins, the link housing 130 pivots in the rotation direction of the motor 110 whereby the pickup roller 140 repeats being on and off the paper. Accordingly, the paper pickup and convey operation is repeated.

According to the present invention described above, since the pickup roller 140 moves apart from the paper after picking up a sheet of paper stacked in the feed cassette 20 as the link housing 130 pivots, the pickup roller 140 can be prevented from causing deteriorating print quality by disturbing the smooth transfer of paper with its own weight unlike the pickup roller 140 in the conventional paper feeding device of an inkjet printer. In addition, the incidence of paper being skewed or jammed by the pickup roller 140 pressing the paper with its own weight can be prevented.

Furthermore, according to the present invention, since the pickup roller 140 is continuously in press contact with the paper while the paper is being picked up, friction between the pickup roller 140 and the paper increases, thereby allowing the paper to be smoothly picked up.

While the invention has been shown and described with reference to certain preferred embodiments thereof, it will be understood by those skilled in the art that various changes in form and details may be made therein without departing from the spirit and scope of the invention as defined by the appended claims.

What is claimed is:

1. A paper feeding device of an inkjet printer comprising:

a motor generating a drive force;

a pickup drive shaft rotated by the motor;

a pivoting link housing having first and second outer surfaces facing in opposite directions, the link housing being pivotably disposed on the pickup drive shaft;

a pickup roller connected to the link housing; and a clutch enlinking the pickup drive shaft and the link housing enabling the link housing to pivot by a predetermined angle by rotation of the pickup drive shaft in a first direction of the motor, the clutch comprising first and second portions respectively in contact with the first and second outer surfaces of the link housing so that the link housing is between the first and second portions.

2. A paper feeding device of an inkjet printer comprising:

a motor generating a drive force;

a pickup drive shaft rotated by the motor;

a pivoting link housing pivotably disposed on the pickup drive shaft;

a pickup roller connected to the link housing; and a clutch enlinking the pickup drive shaft and the link housing enabling the link housing to pivot by a predetermined angle by rotation of the pickup drive shaft, wherein the clutch comprises:

a fixing member on the pickup drive shaft and in contact with a first side of an outer surface of the link housing; and a press on the pickup drive shaft, pressing the link housing towards the fixing member.

3. The paper feeding device of an inkjet printer according to claim 2, wherein the press comprises:

a pressing plate around the pickup drive shaft; and a pressing spring between the pressing plate and a second side opposite to the first side of the outer surface of the link housing.

4. The paper feeding device of an inkjet printer according to claim 2, wherein the press comprises:

a pressing plate fixed around the pickup drive shaft; and a rubber plate between the pressing plate and a second side opposite to the first side of the outer surface of the link housing.

5. The paper feeding device of an inkjet printer according to claim 2, further comprising an abrasion prevention member on a second side opposite to the first side of the outer surface of the link housing, which contacts the press.

6. The paper feeding device of an inkjet printer according to claim 1, wherein the clutch further comprises:

an inner race on an outer surface of the pickup drive shaft; and an outer race in the link housing in contact with an outer surface of the inner race with a predetermined frictional force.

7. A paper feeding device of an inkjet printer comprising:

a motor generating a drive force;

a pickup drive shaft rotated by the motor;

a pivoting link housing pivotably disposed on the pickup drive shaft;

a pickup roller connected to the link housing; and a clutch enlinking the pickup drive shaft and the link housing enabling the link housing to pivot by a predetermined angle by rotation of the pickup drive shaft, wherein the link housing comprises:

a pickup drive gear to drive the pickup roller;

a first link housing on the pickup drive shaft to cover the pickup drive gear on the pickup drive shaft; and a second link housing in the first link housing to pivot by a predetermined angle and having a pickup roller gear geared with the pickup drive gear rotating the pickup roller.

8. A paper feeding device, comprising:

a rotatable pickup drive shaft;

a pivoting link housing, driven in first and second directions by the pickup drive shaft;

a pickup roller connected to the link housing and coupled to the pickup drive shaft; and a clutch which links the link housing and the pickup drive shaft, wherein when the pickup drive shaft rotates in a first direction and the pickup roller comes in contact with paper, the link housing is prevented from pivoting, a slip occurs between the link housing and portions of the rotating pickup drive shaft on opposite sides of the link housing due to the clutch, and the pickup drive shaft forces the pickup roller to engage, and when the pickup drive shaft rotates in the second direction, frictional contact between the link housing and the pickup drive shaft causes the link housing to pivot a second predetermined angle about the pickup drive shaft such that the pickup roller is removed from contact with the paper.

9. The paper feeding device as set forth in claim 8, wherein the clutch further comprises:

an inner race on an outer surface of the pickup drive shaft, and an outer race in the link housing in frictional contact with an outer surface of the inner race.

10. A paper feeding device, comprising:

a rotatable pickup drive shaft;

a pivoting link housing, driven in first and second directions by the pickup drive shaft; and a pickup roller connected to the link housing and coupled to the pickup drive shaft; wherein when pickup drive shaft rotates in a first direction and the pickup roller comes in contact with paper, the link housing is prevented from pivoting, a slip occurs between the link housing and the rotating pickup drive shaft, and the pickup drive shaft forces the pickup roller to engage, and when the pickup drive shaft rotates in the second direction, frictional contact between the link housing and the pickup drive shaft causes the link housing to pivot a second predetermined angle about the pickup drive shaft such that the pickup roller is removed from contact with the paper, wherein the clutch comprises:

a fixing member on the pickup drive shaft in contact with a first outer surface of the link housing; and a press on the pickup drive shaft pressing the link housing towards the fixing member.

11. The paper feeding device as set forth in claim 10, wherein the press comprises:

a fixed plate around the pickup drive shaft, and a spring between the fixed plate and a second outer surface of the link housing opposite to the first outer surface.

12. The paper feeding device as set forth in claim 10, wherein the press comprises:

a fixed plate around the pickup drive shaft, and a rubber plate between the fixed plate and a second outer surface of the link housing opposite to the first outer surface.

13. The paper feeding device as set forth in claim 10, further comprising an abrasion prevention member on a second outer surface of the link housing, opposite to the first outer surface, and in contact with the press.

14. A paper feeding device of an inkjet printer, comprising:

a motor generating a drive force;

a rotatable pickup drive shaft coupled to the motor;

a pivoting link housing, driven in a first direction by the pickup drive shaft, and a pickup roller connected to the link housing and coupled to the pickup drive shaft; wherein when the pickup drive shaft rotates in the first direction and the pickup roller comes in contact with paper, the link housing is prevented from pivoting, a slip occurs between the link housing and portions of the rotating pickup drive shaft on opposite sides of the link housing, and the pickup drive shaft forces the pickup roller to engage, and when the pickup drive shaft rotates in the second direction, frictional contact between the link housing and the pickup drive shaft causes the link housing to pivot a second predetermined angle about the pickup drive shaft such that the pickup roller is removed from contact with the paper.

15. A paper feeding device of an inkjet printer, comprising:

a motor generating a drive force;

a bi-directionally rotatable pickup drive shaft coupled to the motor;

a pivoting link housing, driven in a first direction by the pickup drive shaft;

a pickup roller connected to the link housing and coupled to the pickup drive shaft; wherein when the pickup drive shaft rotates in the first direction and the pickup roller comes in contact with paper, the link housing is prevented from pivoting, a slip occurs between the link housing and the rotating pickup drive shaft, and the pickup drive shaft forces the pickup roller to engage, the pickup drive shaft being prevented from moving in a second direction, opposite the first direction, and when the pickup drive shaft rotates in the second direction, frictional contact between the link housing and the pickup drive shaft causes the link housing to pivot a second predetermined angle about the pickup drive shaft such that the pickup roller is removed from contact with the paper; and an abrasion prevention member on one side of the outer surface of the link housing and in contact with the press.

* * * * *

UNITED STATES PATENT AND TRADEMARK OFFICE

CERTIFICATE OF CORRECTION

PATENT NO. : 7,093,830 B2
APPLICATION NO. : 10/688968
DATED : August 22, 2006
INVENTOR(S) : Sung-wook Kang It is certified that error appears in the above-identified patent and that said Letters Patent is hereby corrected as shown below:

On Title page item 57
First Page Column 2 (Abstract), Line 4, change “ling” to --link--.

Signed and Sealed this

Twenty-third Day of January, 2007

JON W. DUDAS
*Director of the United States Patent and Trademark Office*